US005647557A

United States Patent [19]

Faulkner

[11] Patent Number: 5,647,557

[45] Date of Patent: Jul. 15, 1997

[54] COLLAPSIBLE SPOOL FORMED BY A PLURALITY OF INTERLOCKING PLATES

[75] Inventor: Arnold T. Faulkner, Berrien Springs, Mich.

[73] Assignee: Faulkner Fabricators, Inc., Berrien Springs, Mich.

[21] Appl. No.: 443,481

[22] Filed: May 18, 1995

[51] Int. Cl.[6] ..... B65H 75/24

[52] U.S. Cl. ..... 242/607.1; 242/608.7

[58] Field of Search ..... 242/607.1, 610.1, 242/608.7, 610.3, 608, 614, 118.8, 608.2, 608.6, 571, 575.2, 575.3, 575.5

[56] References Cited

U.S. PATENT DOCUMENTS

| | | | |
|---|---|---|---|
| 221,395 | 11/1879 | Cass | 242/607.1 X |
| D. 277,260 | 1/1985 | Dickens . | |
| 811,899 | 2/1906 | Billstein | 242/607.1 |
| 1,036,643 | 8/1912 | Kilmer et al. | 242/607.1 |
| 1,213,630 | 1/1917 | Halliday . | |
| 1,324,172 | 12/1919 | Rau . | |
| 1,341,815 | 6/1920 | Mossberg . | |
| 1,391,372 | 9/1921 | Connell . | |
| 1,559,133 | 10/1925 | Tunis et al. . | |
| 1,801,054 | 4/1931 | Mossberg . | |
| 1,811,517 | 6/1931 | Mossberg . | |
| 1,816,651 | 7/1931 | Mossberg . | |
| 1,819,337 | 8/1931 | Pevear . | |
| 1,891,709 | 12/1932 | Hescock | 242/607 |
| 1,962,513 | 6/1934 | Lyon . | |
| 2,041,249 | 5/1936 | Johnson . | |
| 2,170,764 | 8/1939 | Penman . | |
| 2,250,281 | 7/1941 | Sundstrand . | |
| 2,339,245 | 1/1944 | Bates . | |
| 2,411,937 | 12/1946 | Powell . | |
| 2,446,583 | 8/1948 | Gopner . | |
| 2,463,192 | 3/1949 | Mackey et al. | 242/607.1 X |
| 2,511,701 | 6/1950 | Eldredge | 242/607.1 X |
| 2,555,851 | 6/1951 | Hancock | 242/607.1 X |
| 2,596,766 | 5/1952 | Dugdale | 242/607.1 X |
| 2,620,144 | 2/1952 | Cloud | 242/607.1 X |
| 2,799,458 | 7/1957 | Nye | 242/118.8 |
| 2,909,340 | 10/1959 | Whitaker | 242/607.1 |
| 3,099,414 | 7/1963 | Kulka . | |
| 3,108,758 | 10/1963 | Hill . | |
| 3,176,932 | 4/1965 | Kovaleski . | |
| 3,276,716 | 10/1966 | Hofbauer . | |
| 3,284,022 | 11/1966 | Eifrid | 242/607.1 |
| 3,301,500 | 1/1967 | Shackson . | |
| 3,342,435 | 9/1967 | Gelardi et al. . | |
| 3,565,363 | 2/1971 | Mizuguchi . | |
| 3,661,341 | 5/1972 | Eifrid | 242/607.1 |
| 3,791,606 | 2/1974 | Brown . | |
| 3,817,475 | 6/1974 | Goldstein | 242/607.1 |
| 3,827,651 | 8/1974 | Benson et al. . | |
| 4,140,289 | 2/1979 | Kovaleski . | |
| 5,106,031 | 4/1992 | Sanda et al. . | |

FOREIGN PATENT DOCUMENTS

| | | | |
|---|---|---|---|
| 310735 | 9/1933 | Italy | 242/118.4 |
| 0799989 | 8/1958 | United Kingdom | 242/118.8 |
| 1006495 | 10/1965 | United Kingdom | 242/614.1 |

*Primary Examiner*—Daniel P. Stodola
*Assistant Examiner*—William A. Rivera
*Attorney, Agent, or Firm*—Barnes & Thornburg

[57] ABSTRACT

A spool includes a plurality of plates having a body and a pair of legs defining a winding area for receiving rope, wire or similar material. Each plate further includes a slot in the body and a tab extending from the body. The tab of one plate is inserted through the slot of another plate to join the various plates. The plates can pivot about their tab and slot joints such that the spool may be collapsed by disengaging one of the tab and slot joints and pivoting the plates to a generally flat position. The tabs may be provided with features such as ears or tongues to prevent undesired separation of the plates.

20 Claims, 3 Drawing Sheets

COLLAPSIBLE SPOOL FORMED BY A PLURALITY OF INTERLOCKING PLATES

BACKGROUND AND SUMMARY OF THE INVENTION

The present invention relates to spools for holding wire, rope and similar materials and, in particular, to a collapsible spool.

Numerous spools are known in the prior art. Such spools typically include a hub around which rope, wire or similar material is wound. The hub is typically bordered by flanges, walls or similar structures for containing the material in a defined area about the hub.

Typically, the spools are manufactured by one party and shipped to another party for use, where the desired material is wound on the spool. As with shipping other products, it is often desirable to minimize the space utilized during shipping, thereby lowering shipping costs.

Accordingly, it is an object of the present invention to provide a spool for winding wire, rope or similar materials.

Another object of the present invention is to provide a spool that reduces the amount of space needed for shipping the spool.

These and other objects of the present invention are attained by the provision of a spool having a plurality of plates, a slot formed in each of the plates and a tab extending from each of the plates through the slot of another one of the plates. The slots may include a plurality of segments.

According to one embodiment of the present invention, each of the tabs includes at least one ear formed thereon. The ears are in a first position which allows them to pass through the slots with the tabs, and are moved to a second position after the tabs are inserted through the slots. In the second position, the ears cannot be pulled back through the slots.

According to another embodiment of the present invention, a pair of legs extends from each of the plates. The legs include tie-off holes for securing the end of the wire or other material to the spool after it is wound thereon.

According to another embodiment of the present invention, each of the tabs includes a tongue thereon. Each of the tongues flexes toward the tab it is on as that tab is inserted through one of the slots. The tongues flex away from the tabs after the tabs are inserted through the slots.

According to another embodiment of the present invention, a lip is located adjacent each of the slots. The lips are located so as to press the tongues toward the tabs on which they are located as the tabs are inserted in the slots. The lips bend the tongues away from the tabs when the tabs are pulled back through the slots without first compressing the tongues toward the tabs.

According to another embodiment of the present invention, a spool comprises a first plate, a second plate and a plurality of plates pivotally joined between the first and second plates such that said spool may be pivoted between a collapsed position and an assembled position. The first and second plates include means for joining said first and second plates when the spool is in the assembled position. The means may include a tab and slot arrangement. Each plate may also include a recessed area for nesting with a corresponding area on an adjacent plate when the spool is in the collapsed position.

Other objects, advantages and novel features of the present invention will now be apparent to those skilled in the art from the following detailed description of the preferred embodiments and accompanying drawings.

DETAILED DESCRIPTION OF THE PREFERRED EMBODIMENTS

Figure 1:
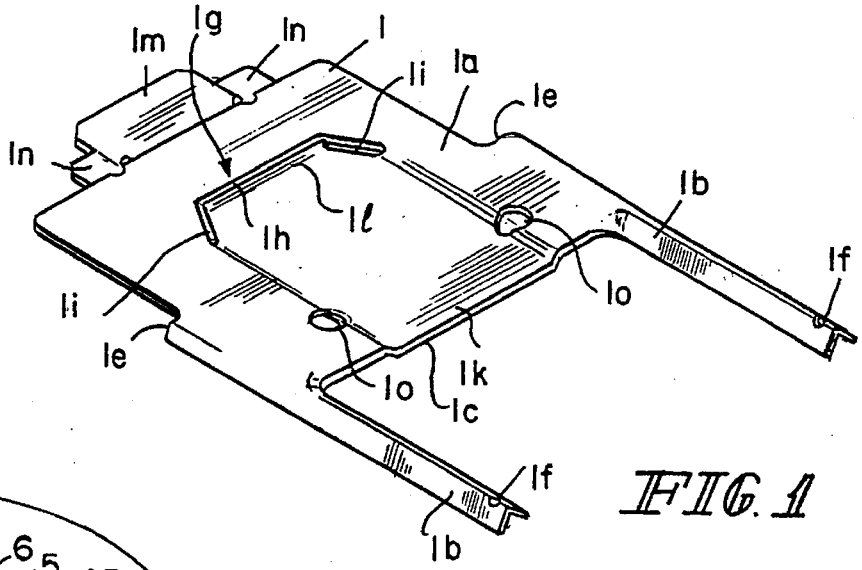
FIG. 1 is a perspective view of a plate that is a component of a spool according to the present invention.

FIG. 1 is a perspective view of a plate 1 that is a component of a spool according to the present invention. Plate 1 is preferably made from a relatively rigid, sturdy material, such as steel, and generally comprises a body 1*a* with a pair of legs 1*b* extending therefrom. Legs 1*b* and edge 1*c* of body 1*a* define a winding area 1*d* within which wire, for example, may be wound. Legs 1*b* are generally V-shaped to provide added strength. The V shape also allows legs 1*b* to nest when the spool is in the collapsed position, as described below. Legs 1*b* are offset from body 1*a* so as to form a notch 1*e* on each side thereof. Each leg 1*b* further includes a tie-off hole 1*f* therein. Holes 1*f* are used to tie off the wire or other material after it is wound on the spool, as described below.

Body 1*a* further includes a slot 1*g* formed therein. Slot 1*g*, in the embodiment shown, includes three segments: 1*h*, 1*i* and 1*j*. A recessed area 1*k* is formed between edge 1*c* and slot 1*g*. Recessed area 1*k* allows the various plates to nest when the spool is in its collapsed position, as described below. A lip 1*l* is formed adjacent slot 1*g* and angles away from body 1*a*. Lip 1*l* assists in holding the various plates of one embodiment of the spool together, as described below.

A tab 1*m* extends from body 1*a* and has a pair of ears 1*n* disposed on each side thereof. Tab 1*m* and ears 1*n* engage a slot corresponding to slot 1*g* on another plate, as described below. Body 1*a* further includes a pair of tie-off holes 1*o* therein. Holes 1*o* provide a means for attaching rope, wire or similar material to the spool before winding begins. Plate 1 can be manufactured by a number of methods. For example, the plates could be stamped from a sheet of steel. The offset arrangement of legs 1*b* of the particular embodiment of plate 1 shown in FIG. 1 allows the plates to be blanked out in a nested pattern. Body 1*a*, including tab 1*m* and ears 1*n*, of one plate are formed from the metal between legs 1*b* of the preceding plate. Legs 1*b* of the preceding plate terminate at notch 1*e* of the following plate. This reduces the amount of scrap metal generated during manufacture.

Figure 2:
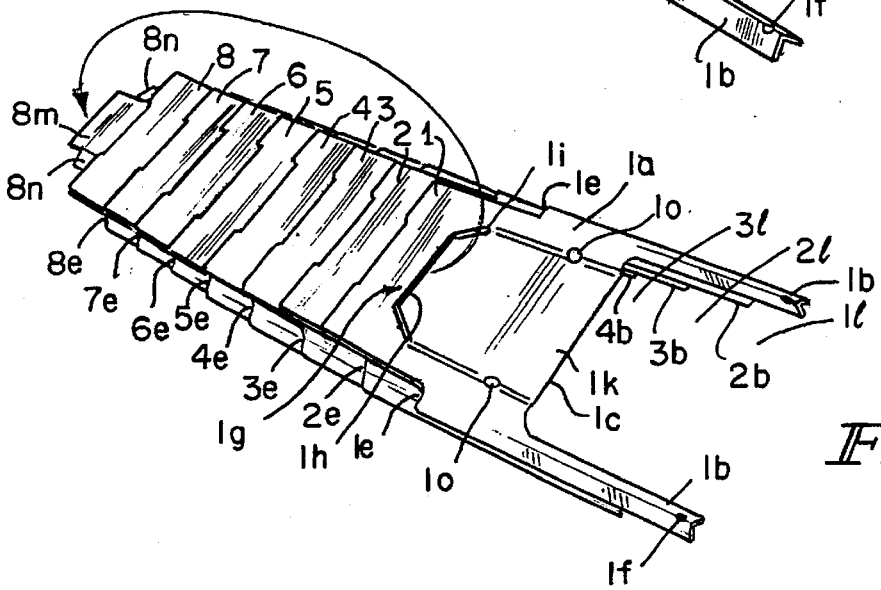
FIG. 2 is a perspective view of a spool according to the present invention in its collapsed state.

Turning to FIG. 2, a spool according to the present invention is shown in its collapsed state. In the particular embodiment shown, the spool consists of eight plates like those shown in FIG. 1. Corresponding letters have been used to indicate corresponding features of the differently numbered plates.

The spool in its collapsed state is assembled by inserting tab 1*m* and ears 1*n* through slot 2*g* (not shown) on plate 2.

Ears 1*n* must be bent at such an angle as to pass through segments 2*i* and 2*j* of slot 2*g*. Ears 1*m* are then bent back to the flat position so that tab 1*m* and ears in cannot pull back through slot 2*g*, thereby disengaging plates 1 and 2. The same process is repeated for the remaining plates such that tab 2*m* and ears 2*n* extend through slot 3*g*, tab 3*m* and ears 3*n* extend through slot 4*g*, tab 4*m* and ears 4*n* extend through slot 5*g*, tab 5*m* and ears 5*n* extend through slot 6*g*, tab 6*m* and ears 6*n* extend through slot 7*g*, and tab 7*m* and ears 7*n* extend through slot 8*g*. In this collapsed position, the various plates nest with one another. For example, the opposite side of recessed area 1*k*, which is a raised area, rests in recessed area 2*k* of plate 2. Similarly, legs 2*b* nest in legs 1*b*.

Figure 3:
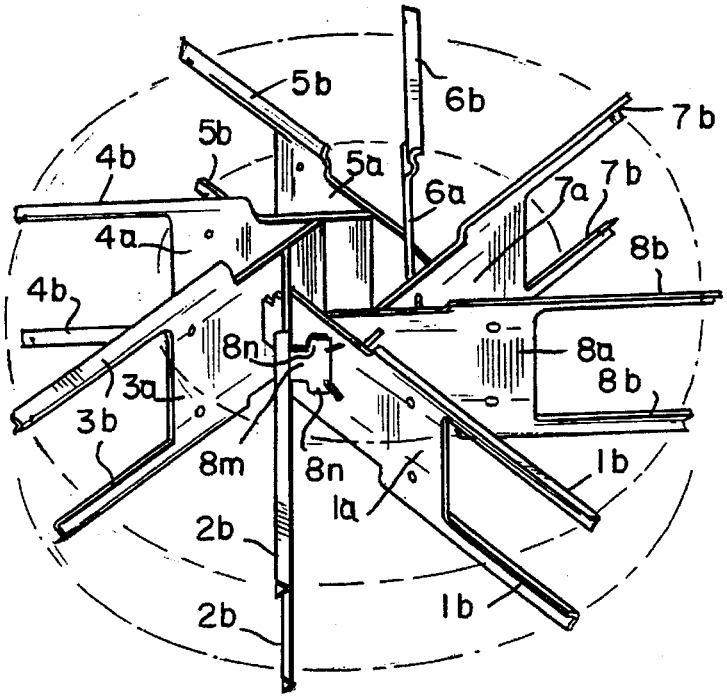
FIG. 3 is a perspective view of a spool according to the present invention in its assembled state.
Figure 4:
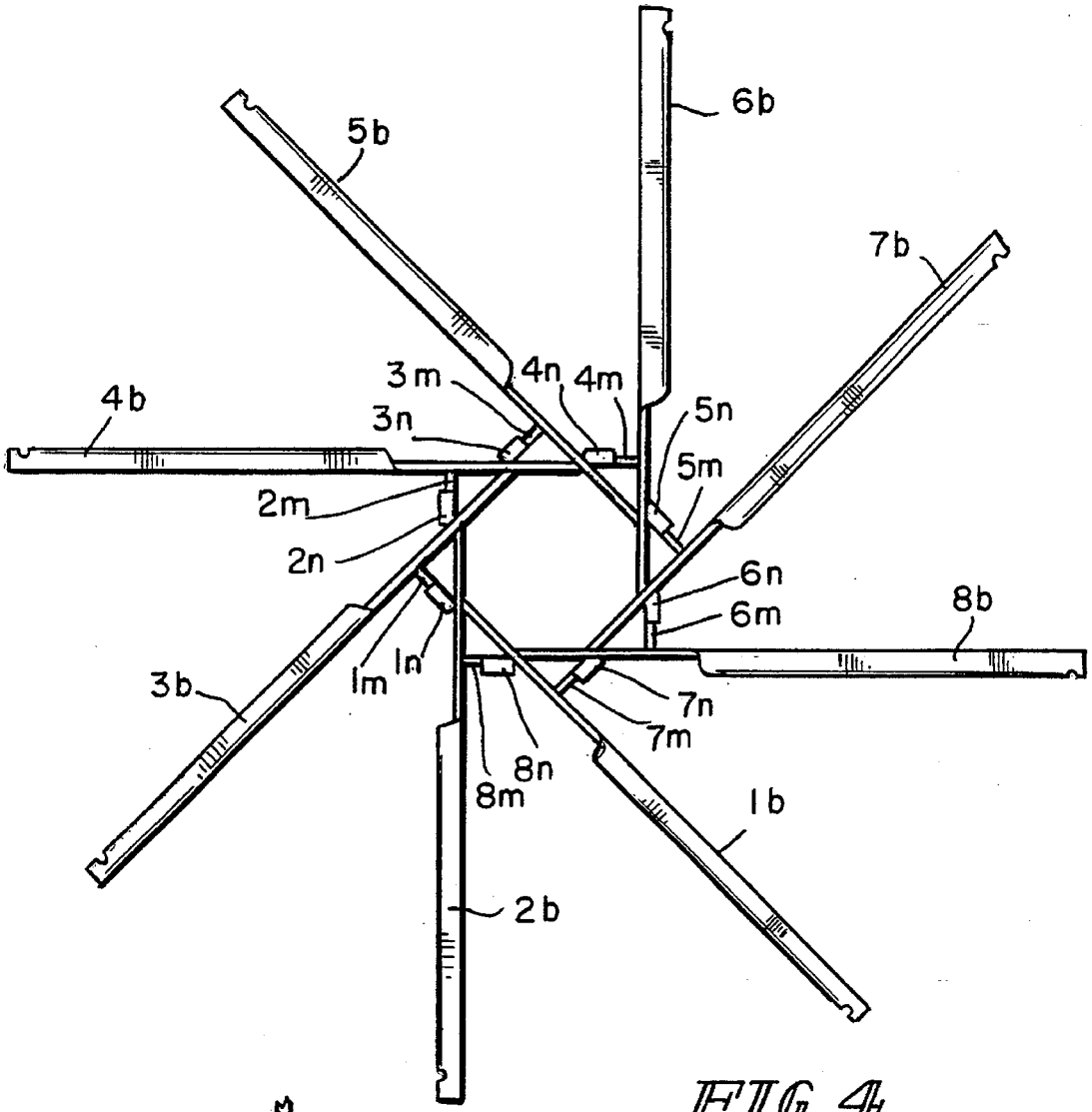
FIG. 4 is a side plan view of the spool shown in FIG. 3.
Figure 5:
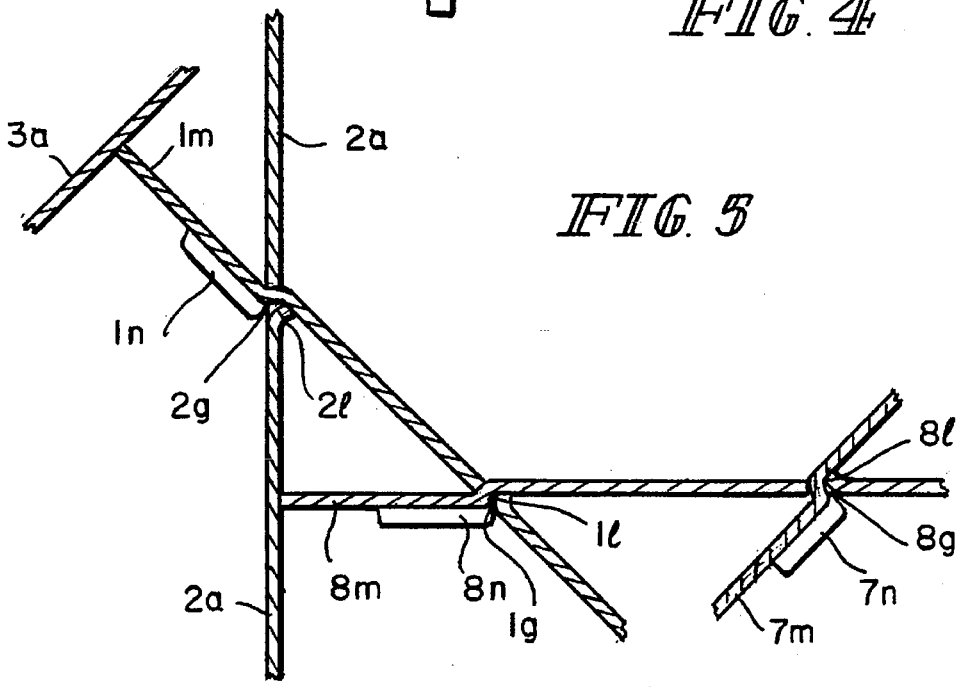
FIG. 5 is an enlarged partial cross-sectional view showing the interlocking relationship among the plates that form components of a spool according to the present invention.

To assemble a spool according to the present invention, the plates are pivoted about the tab/slot joints until tab 8*m* and ears 8*n* are adjacent slot 1*g*. Ears 8*n* are bent so that tab 8*m* and ears 8*n* generally correspond to the configuration of slot 1*g*. Tab 8*m* and ears 8*n* are then inserted through slot 1*g*. Ears 8*n* are then bent such that tab 8*m* and ears 8*n* cannot pull back through slot 1*g*. The assembled spool is shown in FIG. 3. A side plan view of the assembled spool is shown in FIG. 4. FIG. 5 shows a close-up, cross-sectional view of the joints between several of the plates.

Wire, rope or similar material may be wound on the spool by first tying one end to the spool through a tie-off hole 1*o*–8*o*. The material is then wound about edges 1*c*–8*c* between legs 1*b*–8*b*. When winding is complete, the material is tied off through one of the tie-off holes 1*f*–8*f*.

As shown in the figures, the spool occupies less space in its collapsed position than in its assembled position. Thus, it is advantageous to ship the empty spools to the party that will wind the wire, for example, in the collapsed position. This reduces the amount of space needed for shipping. Conversely, more spools can be shipped in a given cargo area. The user can easily assemble the spools for winding.

Figure 6:
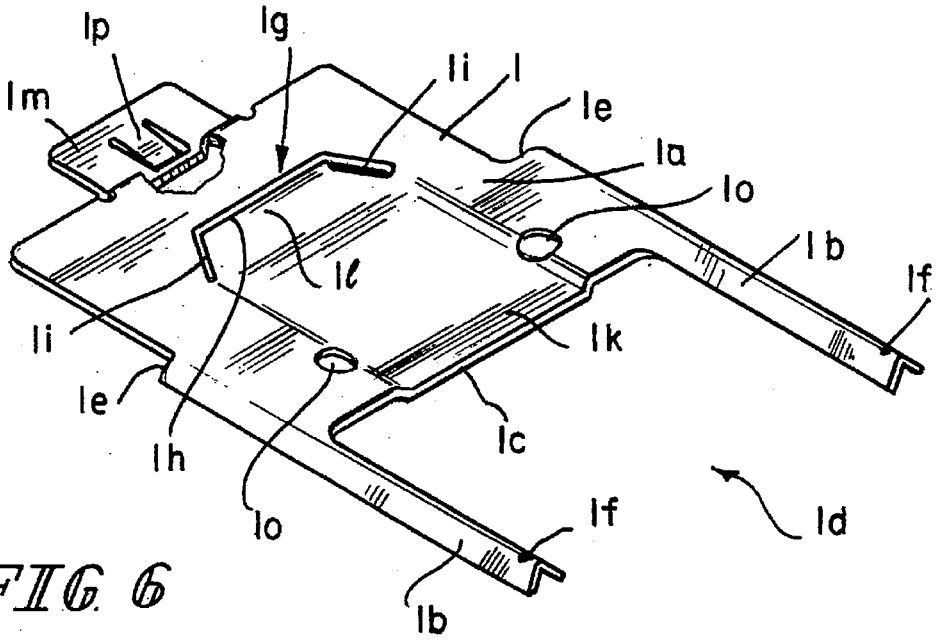
FIG. 6 is a perspective view of an alternative embodiment of a plate that forms a spool according to the present invention.

FIG. 6 shows an alternative embodiment of a plate that forms a component of a spool according to the present invention. For purposes of comparison with the prior embodiment, this plate is also identified as plate 1 and the same letter designations are used for corresponding parts. The plates in this embodiment of the invention differ form those of the prior embodiment in that ears 1*n* have been replaced by a tongue 1*p* on tab 1*m*. Tongue 1*p* is flexible and extends away from tab 1*m* in the opposite direction of lip 1*l*.

Figure 7:
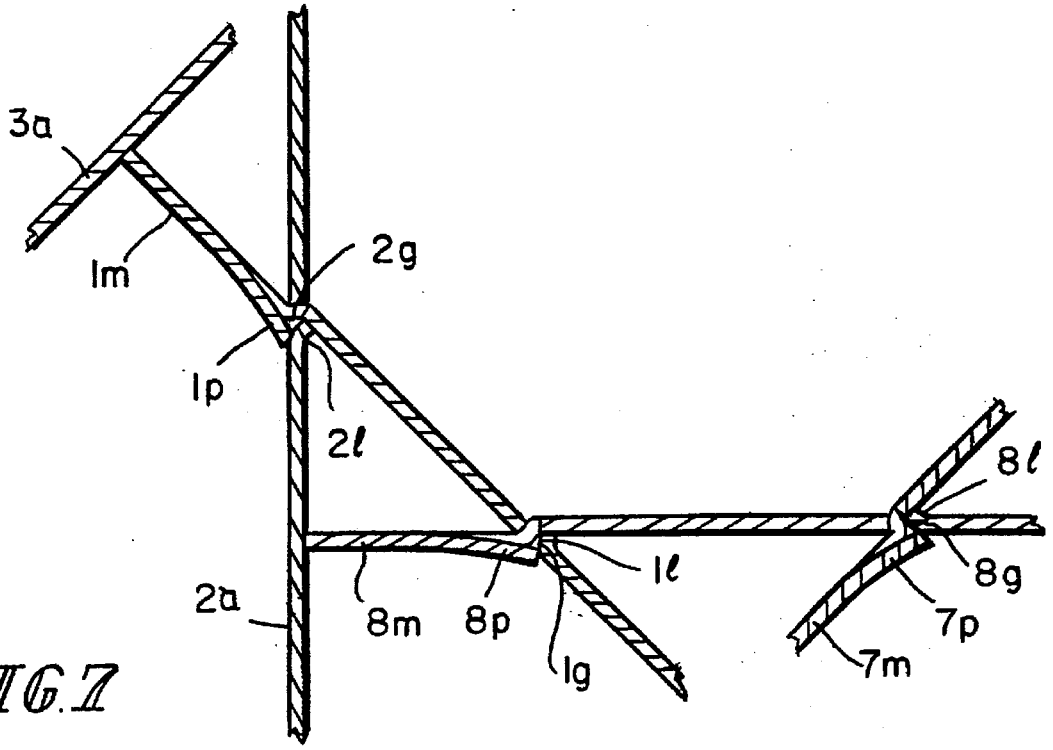
FIG. 7 is an enlarged partial cross-sectional view showing the interlocking relationship among the plates shown in FIG. 6 when assembled to form a spool.

When assembling the spool, tab 1*m* is inserted through slot 2*g*. As this occurs, lip 2*l* presses against tongue 1*p* and causes it to flex toward tab 1*m* as it is inserted through slot 2*g*. When tongue 1*p* is through slot 2*g*, it flexes back to its original position. To disengage plates 1 and 2, tongue 1*p* must be pressed toward tab 1*m* so that it can be pulled back through slot 2*g*. If this is not done, tongue 1*p* will engage the back side of lip 2*l* as plates 1 and 2 are pulled apart. This causes tongue 1*p* to bend farther away from tab 1*m* and press against body 2*a*, thereby preventing plates 1 and 2 from being separated. A plurality of such plates would be joined, as in the prior embodiment, to form a spool. The tab and slot joint arrangement for this embodiment is shown in FIG. 7.

Although the invention has been illustrated and described in detail, it is to be clearly understood that the same is by way of illustration and example only and is not to be taken by way of limitation. Numerous variations may be made to the disclosed embodiments without departing from the scope of the invention. For example, in the embodiment shown in FIGS. 6 and 7, it is not necessary to include segments 1*h* and 1*i* of the slots, as no ears are present to pass through them. The tab and slot arrangements may also be varied in the number of manners. Accordingly, the spirit and scope of the invention are to be limited only by the terms of the appended claims.

What is claimed is:

1. A spool, comprising:

a plurality of plates, each of said plates including a body portion and a pair of spaced apart legs extending from said body portion;

a slot formed in each of said plates; and a tab extending from each of said plates through said slot of another of said plates so as to join said plurality of plates in a generally circumferential arrangement with said legs extending generally radially therefrom.

2. The spool according to claim 1, further comprising an ear on each of said tabs.

3. The spool according to claim 2, wherein said ears are positioned to prevent removal of said tabs from said slots.

4. The spool according to claim 2, wherein said tabs and said ears are removably engaged with said slots.

5. The spool according to claim 1, wherein at least one of said legs includes a tie-off hole therein.

6. The spool according to claim 1, further comprising a tongue on each of said tabs.

7. The spool according to claim 6, wherein each of said tongues flexes toward the tab it is on as that tab is inserted through one of said slots.

8. The spool according to claim 6, wherein each of said tongues flexes away from the tab it is on after said tab is inserted through one of said slots.

9. The spool according to claim 6, wherein said tongues prevent said tabs from pulling through said slots.

10. The spool according to claim 6, further comprising a lip adjacent each of said slots.

11. The spool according to claim 10, wherein said lips are located so as to press said tongues toward the tabs on which they are located as said tabs are inserted in said slots.

12. The spool according to claim 10, wherein said lips are located so as to bend said tongues away from said tabs on which they are located when said tabs are pulled back toward said slots without first compressing said tongues toward said tabs.

13. The spool according to claim 1, wherein said slots include a plurality of segments.

14. The spool according to claim 1, wherein said tabs are formed on said body portions of said plurality of plates.

15. The spool according to claim 1, wherein said body portions of said plurality of plates are joined in a generally circumferential arrangement.

16. The spool according to claim 1, wherein said body portions and said legs are integrally formed.

17. The spool according to claim 1, wherein said body portions form a winding surface for wire or rope.

18. The spool according to claim 1, wherein said body portions and said legs define a winding space for wire or rope.

19. The spool according to claim 1, wherein each of said body portions includes an edge and said edges are arranged in a generally circumferential manner.

20. The spool according to claim 18, wherein said edges of said body portions form a winding surface for wire or rope.

* * * * *